US005949276A

United States Patent [19]

Chen

[11] Patent Number: 5,949,276

[45] Date of Patent: Sep. 7, 1999

[54] ADJUSTABLE BIAS VOLTAGE GENERATING APPARATUS

[75] Inventor: Chih-Hung Chen, Hsinchu, Taiwan

[73] Assignee: United Microelectronics Corp., Taiwan

[21] Appl. No.: 08/754,172

[22] Filed: Nov. 25, 1996

[51] Int. Cl.[6] ..... G05F 3/02

[52] U.S. Cl. ..... 327/541; 327/540; 323/312

[58] Field of Search ..... 327/538, 540, 327/541, 543; 323/312, 315

[56] References Cited

U.S. PATENT DOCUMENTS

| | | | |
|---|---|---|---|
| 4,868,416 | 9/1989 | Fitzpatrick et al. | 327/541 |
| 5,081,380 | 1/1992 | Chen | 327/541 |
| 5,391,979 | 2/1995 | Kajimoto et al. | 323/313 |
| 5,448,159 | 9/1995 | Kojima et al. | 323/315 |
| 5,459,423 | 10/1995 | Nozawa et al. | 327/277 |
| 5,675,280 | 10/1997 | Nomura et al. | 327/538 |

*Primary Examiner*—Terry D. Cunningham
*Attorney, Agent, or Firm*—Rabin & Champagne, P.C.

[57] ABSTRACT

An adjustable bias voltage generator included in a semiconductor IC device utilizes fabrication factory-programmable fuses and connectors for enabling bias adjustment. The generator utilizes factory-programmable fuses and connectors for implementing bias adjustment. The generator includes pull-up logic that includes a number of voltage pull-up elements for connection to a system power supply voltage. Pull-down logic includes a number of voltage pull-down elements for connection to a system ground voltage. A voltage divider is connected to the pull-up logic and the pull-down logic for generating the bias voltage. A number of fuses, each connected to a corresponding one of the pull-down elements and for connection to the system ground voltage, is used for selectively connecting the pull-down elements to the system ground voltage to enable pull-down thereof. A number of connectors, some connected to a corresponding one of the pull-up elements and for connection to the system power supply voltage, and others connected to a corresponding one of the pull-down elements and for connection to the system ground voltage, may be used for selectively connecting the pull-up or pull-down elements to the system power supply voltage or system ground voltage, to enable pull-up and pull-down thereof, respectively. The fuses and connectors enabling control of the bias voltage output by the generator are implemented in the top metallization layer of the IC device.

8 Claims, 1 Drawing Sheet

ADJUSTABLE BIAS VOLTAGE GENERATING APPARATUS

BACKGROUND OF THE INVENTION

1. Field of the Invention

The invention relates in general to a bias voltage generator, and in particular, to an adjustable bias voltage generator. More particularly, the invention relates to a bias voltage generator which includes selectable voltage divider circuitry allowing for a bias voltage output that is adjustable to meet IC circuitry functional needs.

2. Technical Background

Conventional bias voltage generators employed in integrated circuit (IC) devices (which include, for example, MOS transistors) have fixed bias generation. Once a bias value that was selected for a specific semiconductor IC device requires adjustment, not only must the dimensional configuration of the MOS transistor be modified, the circuitry may have to be modified as well. The IC layout may also have to be altered, which would inevitably lead to changing the procedural fabrication steps involved in the manufacture of the device. Such disadvantageous modifications to the semiconductor device result directly in manufacturing delays and cost increases.

SUMMARY OF THE INVENTION

It is therefore an object of the invention to provide an adjustable bias voltage generator that is capable of easily adjusting the bias output thereof.

It is another object of the invention to provide an adjustable bias voltage generator that is capable of easily adjusting the bias output without incurring sophisticated alteration and cost increases in the fabrication of the IC device.

It is still another object of the invention to provide an adjustable bias voltage generator that is capable of bias output adjustment by mere alteration of the top metallization photomask layer.

The invention achieves the above-identified and other objects by providing an adjustable bias voltage generator electronic circuit included in a semiconductor IC device. The generator utilizes factory-programmable fuses and connectors for implementing bias adjustment. The generator includes pull-up logic that includes a number of voltage pull-up up elements for connection to a system power supply voltage. Pull-down logic includes a number of voltage pull-down elements for connection to a system ground voltage. A voltage divider is connected to the pull-up logic and the pull-down logic for generating the bias voltage. A number of fuses, each connected to a corresponding one of the pull-down elements and for connection to the system ground voltage, is used for selectively connecting the pull-down elements to the system ground voltage to enable pull-down thereof. A number of connectors, some connected to a corresponding one of the pull-up elements and for connection to the system power supply voltage, and others connected to a corresponding one of the pull-down elements and for connection to the system ground voltage, may be used for selectively connecting the pull-up or pull-down elements to the system power supply voltage or system ground voltage, to enable pull-up and pull-down thereof, respectively. The fuses and connectors enabling control of the bias voltage output by the generator are implemented in the top metallization layer of the IC device.

BRIEF DESCRIPTION OF THE DRAWING

Other objects, features, and advantages of the invention will become apparent by way of the following detailed description of the preferred but non-limiting embodiment. The description is made with reference to the accompanying drawing in which.

DETAILED DESCRIPTION OF A PREFERRED EMBODIMENT

Figure 1:
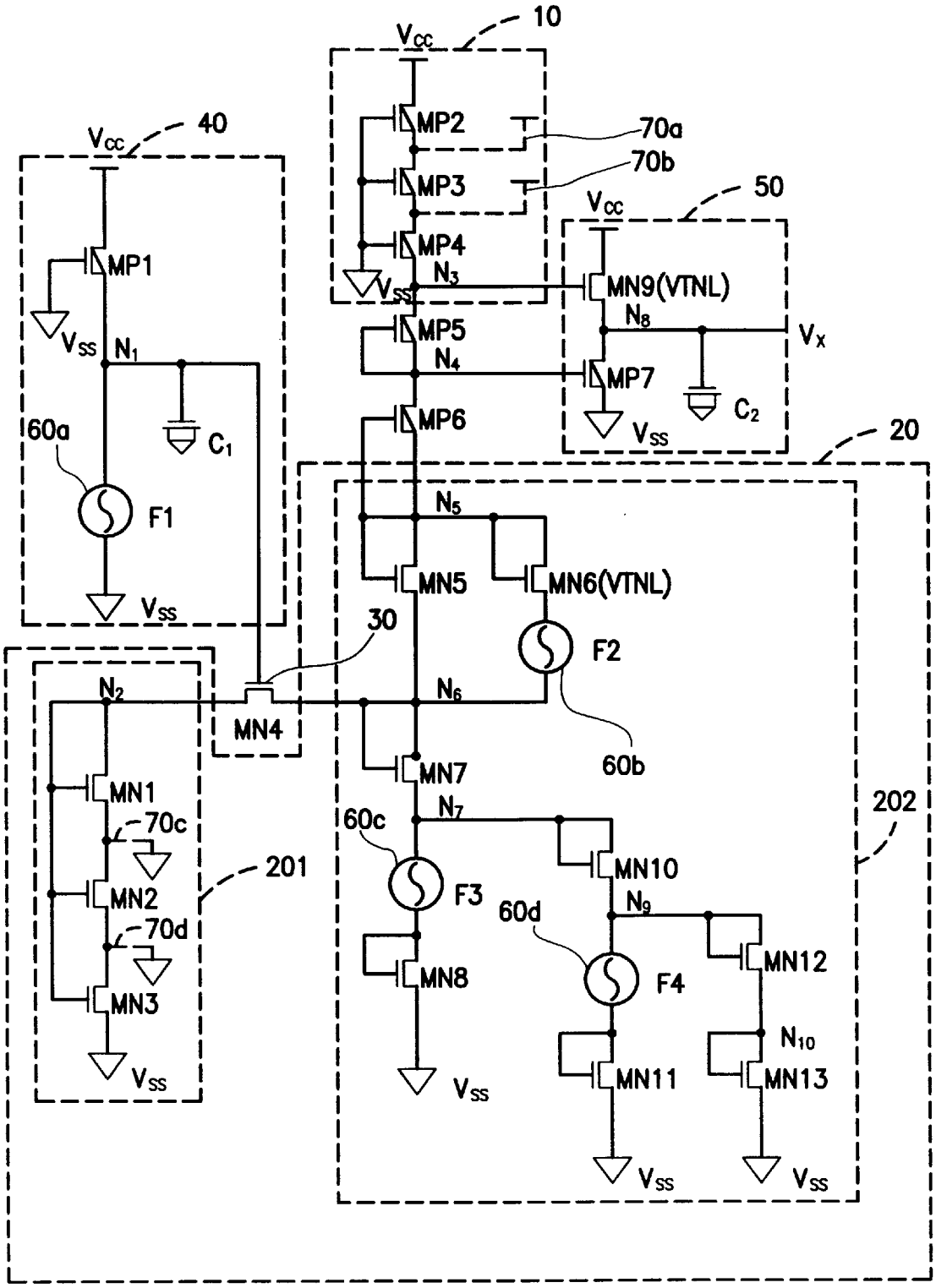
FIG. 1 is a schematic diagram showing an adjustable bias circuit in accordance with a preferred embodiment of the invention.

The adjustable bias voltage generator of the invention is based in principle on selectable voltage divider-based circuitry. As shown in the described preferred embodiment of the invention as depicted in the schematic diagram of FIG. 1, the adjustable bias voltage generator includes several functional components which are generally distinguished from each other by phantom-lined blocks. These functional components generally include pull-up logic 10, pull-down logic 20, control logic 40, and a voltage divider 50. The pull-down logic 20 includes a first set of pull-down elements 201 and a second set of pull-down elements 202. The adjustable bias voltage generator also includes a switch 30, such as an NMOS transistor MN4, and two PMOS transistors MP5 and MP6. Several fuses 60*a*—60*d* and selectable connectors 70*a*—70*d* are components utilized to adjust the bias voltage generator, as will be described in the following paragraphs.

The pull-up logic 10 includes a serial cascade of pull-up elements, for example, PMOS transistors MP2, MP3, and MP4. One end of the transistor cascade is connected to the system power voltage, $V_{CC}$, of the IC device. All the gates of the pull-up transistors MP2, MP3, and MP4 are connected to the system ground potential, $V_{SS}$. This component provides pull up voltages for the bias voltage.

As mentioned above, the pull-down logic 20 is a component including first and second sets of pull-down elements 201 and 202, respectively. The first set of pull-down elements 201 includes a serial cascade of NMOS transistors MN1, MN2, and MN3. One end of the cascade is tied to a system ground potential $V_{SS}$, while the other end, the node identified in the figure as node N2, is connected to the second set of pull-down elements 202 at a node N6 thereof through the switch 30. The second set of pull-down elements 202 includes NMOS transistors, which each having one of the drains and sources thereof tied to system ground potential $V_{SS}$. Essentially, the switch 30 enables parallel connection between the two sets of pull-down elements 201 and 202 as pull down is required.

The control logic 40 is basically a PMOS transistor MP1 connected to system ground $V_{ss}$ through both a fuse 60*a* and a capacitor $C_1$. The gate of the transistor MP1 itself is tied to ground $V_{SS}$. A common connection node, N1, of the PMOS transistor MP1, the fuse 60*a*, and the capacitor $C_1$ is the control point that is connected to the gate of the switch 30, the NMOS transistor MN4. Thus, the output of the control logic 40 determines whether the first and second sets of pull-down elements 201 and 202 will be connected in parallel.

The voltage divider 50 includes PMOS and NMOS transistors MP7 and MN9, respectively, as well as a capacitor $C_2$. The pair of transistors MN9 and MP7 are connected in series, with one end of the series connection tied to the system power voltage $V_{CC}$ and the other end to the system ground potential $V_{SS}$. A joining node, N8, of the two transistors also provides for a connection to the capacitor $C_2$ at one of the two electrodes thereof; the other electrode thereof is tied to the system ground potential $V_{SS}$. The gate of the transistor that is connected directly to the system power voltage $V_{CC}$, namely NMOS transistor MN9, is connected to the end of the transistor cascade in the pull-up logic 10 that is not tied to system power voltage $V_{CC}$. The gate of the transistor that is connected directly to the system ground voltage $V_{SS}$, namely PMOS transistor MP7, is connected to the joint node, N4, of the two PMOS transistors MP5 and MP6, which are connected in series between the pull-up logic 10 and the pull-down logic 20.

A number of fuses 60*a*, 60*b*, 60*c*, and 60*d* are arranged in the control logic 40 and the pull-down logic 20. These fuses control electrical connections in the control logic 40 and in the pull-down logic 20. The fuses can be fabricated in the second metallization layer of the semiconductor IC device utilizing the adjustable bias voltage generator. During fabrication of the IC device, the fuses can each be selectively implemented as a closed- or open-circuit fuse to enable connection of circuit components connected to both ends thereof.

In a similar manner, a number of connectors 70*a*, 70*b*, 70*c*, and 70*d* are used to enable selective connection of circuit components in the pull-up logic 10 and the pull-down logic 20 to the system power and ground voltages, respectively, in accordance with the circuit design requirements. Likewise, these connectors can be fabricated in the second metallization layer of the semiconductor IC device utilizing the adjustable bias voltage generator. During fabrication of the IC device, the connectors can each be selectively implemented as a close-circuit connector, or remain an open-circuited, ineffective connector, to enable connection of circuit components to either the power supply voltage $V_{CC}$ or the system ground potential $V_{SS}$ as the circuit design requires. Thus, selective use of these connectors may be utilized to determine the bias generated.

Essentially, based on the selective combined use of the fuses 60*a*—60*d* and the connectors 70*a*—70*d*, the bias voltage generator of the invention may be programmed to generate the required bias $V_X$ at the voltage divider 50. Thus, the generated output bias voltage $V_X$ can be adjusted to match the variable requirements of the semiconductor IC device being fabricated, as shown, for example, in the embodiment of the invention depicted in the schematic diagram of FIG. 1. In a situation wherein all the fuses 60*a*—60*d* are not blown and remain closed-circuited, and all the connectors 70*a*—70*d* are not connected and remain open-circuited, voltages appearing at nodes N3 and N4 determine the conduction status of the transistors MN9 and MP7. These voltages in turn determine the output voltage at the N8 node, the generated bias voltage $V_X$. When, however, the fuses and connectors are arranged in different patterns of open- and closed-circuit connection status, the voltages at nodes N1, N6, N7, N9, N3, and N2 vary. This leads to voltage changes at node N8, thereby generating a bias voltage $V_X$ having different possible levels to fit the need of the IC device circuitry.

To implement open-circuit connections in the fuses 60*a*—60*d* and/or closed-circuit connections in the connectors 70*a*—70*d*, the metallization layer in which the fuses and connectors are formed may be altered when fabricating the IC device having the inventive adjustable bias voltage generator. This can be easily accomplished by using different photomasks for the metallization layer. An important advantageous feature of the invention is that preparation of these photomasks is relatively easy, since all the fuses and connectors are devices that are simple to implement in the layer. For IC devices utilizing more than two layers of metallization, these fuses and connectors may be fabricated in the top metallization layer so as to reduce the influence on the fabrication of the other layers of the IC device.

A few examples of generating different bias voltages at the $V_X$ node will be illustrated in the following paragraphs. The discussion will refer to the adjustable bias voltage generator depicted in the drawing as the preferred embodiment of the invention. In the following discussion, it is assumed that the original status of the fuses and connectors is one in which they are closed- and open-circuited, respectively. Programming these fuses and connectors, as mentioned above, is relatively easy, by blowing the fuses into an open-circuit status and connecting the connectors into a close-circuit status, respectively.

In one case wherein only the fuse 60*a* is programmed into open-circuit status, the voltage at node N1 will be raised substantially to the $V_{CC}$ level. This turns on the switch 30, the transistor MN4. As a result of conduction in the switch 30, the first and second sets of pull-down elements 201 and 202 in the pull-down logic 20 are then connected together in parallel to the system ground potential. The voltage at node N6, effectively the node of connection between the two sets of pull-down elements 201 and 202, decreases to a lower level than in the case when the fuse 60*a* was maintained in its original state. The voltage at node N6 decreases because pull-down is enhanced as a result of conduction in fuse 60*a*. The voltages at nodes N3 and N4 also decrease as a result. As a result, transistor MN9 in the voltage divider 50 has a lower level of conduction, while the transistor MP7 has a higher level of conduction. In this situation, the bias voltage $V_X$ generated at node N8 decreases.

On the other hand, in the case wherein only the fuse 60*b* is programmed into open-circuit status, the voltage at node N5 increases as a result of the cutoff of the transistor MN6, if the transistor MN6 installed was a low-threshold (VTNL,) device. This increases the voltages at nodes N3 and N4. As a result, the bias voltage $V_X$ generated at node N8 is increased.

Further, in the case wherein either fuse 60*c* or 60*d* is programmed into an open-circuit status, the bias voltage output $V_X$ at node N8 has a level higher than in the original state. The extent of the bias voltage increase can be controlled by programming the fuses 60*b*, 60*c*, and 60*d* in different combinations of conduction status. Even in the case where the bias voltage $V_X$ is increased to too great a degree through blowing of the fuses, fuse 60*a* can still be blown into its open-circuit status to further bring pull-down elements MN1, MN2, and/or MN3 in the first pull-down element set 201 to the system ground potential $V_{SS}$ by properly programming the status of connectors 70*c* and/or 70*d*. Programming of the connectors 70*c* and 70*d* in pull-down element set 201 into a closed-circuit status has the effect of modifying the level of bias output voltage $V_X$ at node N8 in the downward direction.

With the fuse 60*c* programmed into an open-circuit status, the voltage dividing does not take effect via the transistor MN8. Rather, transistors MN10, MN11, MN12, and MN13 are involved instead. On the other hand, when both the fuses 60*c* and 60*d* are programmed into an open-circuit state, voltage dividing is implemented via the path including transistors MN10, MN12, and MN13. The voltages at nodes N3 and N4 increase as a result, and the bias output voltage $V_X$ at node N8 is significantly increased.

The concept of the adjustable bias voltage generator of the invention is based on the design consideration that the fuses and connectors in an IC device metallization layer are easily controlled. Relatively easy implementation of this adjustment control can be achieved with substantially no effect on the fabrication of the IC device except in the use of a different photomask when the metallization is processed. The combination of the conduction arrangement of the fuses and connectors allows a bias output to be generated by the generator at the desired voltage level.

One of the possible applications of such an adjustable bias voltage generator is in controlling the power supply voltage of buffers in the output stage of an IC circuit. For example, in conventional SRAM (static random-access memory), synchronous SRAM, or DRAM (dynamic random-access memory), wherein a 5 V power supply voltage is used for internal memory operations, output stages thereof can be controlled to be compatible with the 3.3 V peripheral circuitry of the systems making use of them. In such applications, the adjustable bias voltage generator of the invention can be used to control the power supply circuitry supplying power to the last output stage of these memory devices. For example, the bias output $V_X$ of the invention can be adjusted so that the voltage $V_{OH}$ of high-level output signals in the output stages of these memory devices to be in the specified range of the peripheral circuitry (essentially, $2.4\ V \leqq V_{OH} \leqq 3.3\ V$).

The adjustable bias voltage generator of the invention can even provide tolerance for precision tuning of the bias output if discrepancies in the IC device fabrication conditions occur and the targeted bias level shifts as a result. The tuning can be achieved, as described above, by programming in the conduction status of the fuses and connectors in a properly selected combination of conduction.

As another exemplary application, in the case of conventional SRAM differential sense-amplifying circuitry, the MOS transistor used as the current source may also have its gate voltage controlled by the adjustable bias voltage generator of the invention. The current source transistor may thus be maintained in a saturated mode of operation, so that the drain-source current $I_{DS}$ may be maintained at a constant level, regardless of the change in the drain-source voltage $V_{DS}$. This allows for a voltage gain increase at the differential sense amplifier, as well as an increase in the sensing speed, in SRAM devices.

Thus, the adjustable bias voltage generator of the invention as described above with respect to a preferred embodiment is suitable for use in semiconductor IC devices that have the capability of being adjusted during device fabrication. The adjustment can be implemented in a manner that does not add a level of complexity to the fabrication of the device itself, which is the case with conventional bias generation circuits in IC devices, wherein the circuitry layout may have to altered. Modification of the biasing in conventional IC devices normally requires change in a number of procedures, including modification of various photomasks when the device layout is changed, even though the biasing difference may be minor in scope. To the contrary, the concept of adjustable bias generation of the invention requires no more than the replacement of a photomask in the later stages of device fabrication when the metallization layer is implemented. As a result, costs can be controlled such that they do not substantial increase, and the device production schedule can be controlled.

Thus, while the invention has been described by way of examples and in terms of a preferred embodiment, it is to be understood that the invention is not limited thereto. To the contrary, it is intended to cover various modifications as well as similar arrangements included within the spirit and scope of the invention. The scope of the appended claims, therefore, should be accorded the broadest possible interpretation so as to encompass all such modifications and similar arrangements.

What is claimed is:

1. An adjustable bias voltage generator for circuitry included in a semiconductor integrated circuit device, comprising:

pull-up means, including a plurality of voltage pull-up elements for connection in series to a system power supply voltage of the integrated circuit device;

pull-down means, connected to said pull-up means and including a plurality of voltage pull-down elements for connection to a system ground voltage of said integrated circuit device, said plurality of voltage pull-down elements including a first set of pull-down elements and a second set of pull-down elements;

a switch means connected between said first set of pull-down elements and said second set of pull-down elements of said pull-down means for controlling the connection therebetween;

a voltage divider means connected to said pull-up means and said pull-down means for generating said bias voltage;

a plurality of pull-down fuse means, each connected to a corresponding one of said plurality of voltage pull-down elements and for connection to the system ground voltage for selectively connecting said voltage pull-down elements to the system ground voltage to enable pull-down thereof;

a first plurality of connector means, each connected to a corresponding one of said plurality of pull-up elements and for connection to the system power supply voltage, for selectively connecting said pull-up elements to the system power supply voltage to enable pull-up thereof; and a second plurality of connector means, each connected to a corresponding one of said plurality of voltage pull-down elements and for connection to the system ground voltage for selectively connecting said voltage pull-down elements to the system ground voltage to enable pull-down thereof.

2. The adjustable bias voltage generator of claim 1, wherein said first set of pull-down elements includes three MOS transistors connected in series, said series connection having one end for connection to said system ground voltage and another end connected to said switch means.

3. The adjustable bias voltage generator of claim 1, wherein said second set of pull-down elements comprises a plurality of series-connected MOS transistors and a plurality of MOS transistors connected in parallel with respective ones of said series-connected MOS transistors.

4. The adjustable bias voltage generator of claim 1, further comprising control means, which includes a PMOS transistor, a pull-up fuse means, and a capacitor, wherein said PMOS transistor includes a first drain/source terminal for connection to the system power supply voltage and a second drain/source terminal for connection to the system ground voltage through said pull-up fuse means, and said capacitor is connected in parallel with said fuse means for connection to the system ground voltage.

5. The adjustable bias voltage generator of claim 1, wherein said switch means is a MOS transistor.

6. The adjustable bias voltage generator of claim 1, wherein said voltage divider means includes an NMOS transistor, a PMOS transistor, and a capacitor.

7. An adjustable bias voltage generator for circuitry, suitable for inclusion in a semiconductor integrated circuit device, comprising pull-up means, including a plurality of voltage pull-up elements for connection to a system power supply voltage of the integrated circuit device;

pull-down means, including a plurality of voltage pull-down elements for connection to a system ground voltage of the integrated circuit device;

a voltage divider means connected to said pull-up means and said pull-down means for generating said bias voltage;

a plurality of fuse means, each connected to a corresponding one of said plurality of pull-down elements and for connection to the system ground voltage for selectively connecting said pull-down elements to the system ground voltage to enable pull-down thereof;

a first plurality of connector means, each connected to a corresponding one of said plurality of pull-up elements and for connection to the system power supply voltage, for selectively connecting said pull-up elements to the system power supply voltage to enable pull-up thereof; and a second plurality of connector means, each connected to a corresponding one of said plurality of pull-down elements and for connection to the system ground voltage for selectively connecting said pull-down elements to the system ground voltage to enable pull-down thereof;

wherein the pull-down means includes first pull-down means and second pull-down means, the adjustable bias voltage generator further comprising control means for selectively connecting the first pull-down means to the second pull-down means.

8. An adjustable bias voltage generator for circuitry, suitable for inclusion in a semiconductor integrated circuit device, comprising:

pull-up means, including a plurality of voltage pull-up elements for connection to a system power supply voltage of the integrated circuit device;

pull-down means, including a plurality of voltage pull-down elements for connection to a system ground voltage of the integrated circuit device;

a voltage divider means connected to said pull-up means and said pull-down means for generating said bias voltage;

a plurality of fuse means, each connected to a corresponding one of said plurality of pull-down elements and for connection to the system ground voltage for selectively connecting said pull-down elements to the system ground voltage to enable pull-down thereof;

a first plurality of connector means, each connected to a corresponding one of said plurality of pull-up elements and for connection to the system power supply voltage, for selectively connecting said pull-up elements to the system power supply voltage to enable pull-up thereof; and a second pluralily of connector means, each connected to a corresponding one of said plurality of pull-down elements and for connection to the system ground voltage for selectively connecting said pull-down elements to the system ground voltage to enable pull-down thereof;

wherein the pull-down means is first pull-down means including a first plurality of voltage pull-down elements, the adjustable bias voltage generator further comprising:

second pull-down means including a second plurality of voltage pull-down elements for connection to the system ground voltage of the integrated circuit device, and control means for selectively connecting the first pull-down means to the second pull-down means.

* * * * *